US007708861B2

(12) United States Patent
Hook et al.

(10) Patent No.: US 7,708,861 B2
(45) Date of Patent: May 4, 2010

(54) FORMULATIONS FOR HIGH SPEED PRINT PROCESSING

(75) Inventors: Kevin J. Hook, Grand Island, NY (US); Henderikus A. Haan, North Tonawanda, NY (US); Myron C. Heeb, West Seneca, NY (US)

(73) Assignee: RR Donnelley, Chicago, IL (US)

( * ) Notice: Subject to any disclaimer, the term of this patent is extended or adjusted under 35 U.S.C. 154(b) by 541 days.

(21) Appl. No.: 11/654,059

(22) Filed: Jan. 16, 2007

(65) Prior Publication Data

US 2007/0199671 A1 Aug. 30, 2007

Related U.S. Application Data

(60) Provisional application No. 60/765,353, filed on Feb. 3, 2006.

(51) Int. Cl.
*D21F 11/00* (2006.01)

(52) U.S. Cl. ..... 162/135; 106/2; 162/179

(58) Field of Classification Search ..... 162/135, 162/179; 106/2

See application file for complete search history.

(56) References Cited

U.S. PATENT DOCUMENTS

| | | | |
|---|---|---|---|
| 1,463,881 | A | 8/1923 | Farrell et al. |
| 1,626,522 | A | 4/1927 | Freiberg |
| 2,237,068 | A | 4/1941 | Bradner |
| 2,491,526 | A | 12/1949 | Sparks et al. |
| 2,538,397 | A | 1/1951 | Szwarc |
| 2,809,121 | A | 10/1957 | Davis et al. |
| 3,305,392 | A | 2/1967 | Britt |
| 3,567,482 | A | 3/1971 | George et al. |
| 3,674,535 | A | 7/1972 | Blose et al. |
| 4,076,870 | A | 2/1978 | Yamamoto |
| 4,785,734 | A | 11/1988 | Kawana et al. |
| 4,801,919 | A | 1/1989 | Hansen et al. |
| 4,870,427 | A | 9/1989 | Kobayashi et al. |
| 5,080,717 | A | 1/1992 | Young |
| 5,879,748 | A | 3/1999 | Conti et al. |
| 5,993,960 | A | 11/1999 | Nakayama et al. |
| 6,081,678 | A | 6/2000 | Kato |
| 6,207,014 | B1 | 3/2001 | de Haut et al. |
| 6,235,397 | B1 | 5/2001 | Nakayama et al. |
| 6,775,511 | B2 | 8/2004 | Kosuge |
| 2004/0226671 | A1 | 11/2004 | Nguyen et al. |
| 2005/0158090 | A1 | 7/2005 | Segerer et al. |
| 2005/0158099 | A1 | 7/2005 | Segerer et al. |
| 2005/0233098 | A1 | 10/2005 | Asano et al. |
| 2006/0008296 | A1 | 1/2006 | Sampe et al. |

FOREIGN PATENT DOCUMENTS

| | | |
|---|---|---|
| DE | 40 09 065 | 10/1990 |
| EP | 291 315 | 11/1988 |
| EP | 507 998 | 10/1992 |
| EP | 860 547 | 8/1998 |
| EP | 1 323 863 | 7/2003 |
| JP | 52-89612 | 7/1977 |
| JP | 52089612 | 7/1977 |
| JP | 405085074 A | 4/1993 |
| SU | 2164017 | 6/1975 |

OTHER PUBLICATIONS

Search Report in EP 08 01 5521 dated Jan. 13, 2009.
International Search Report and Written Opinion, International Application No. PCT/US07/03241 dated Sep. 27, 2007.
Search Report in EP Application No. 07763463.2 dated Sep. 25, 2009.

*Primary Examiner*—Mark Halpern
(74) *Attorney, Agent, or Firm*—McCracken & Frank LLP

(57) ABSTRACT

An anti-blocking composition including about 75% to about 99% weight percent a metal salt of stearate and about 1% to about 25% weight percent stearic acid is provided. In addition, an anti-blocking composition including about 90% to about 99.5% a metal salt of stearate and about 0.5% to about 10% fiber is provided. The anti-blocking compositions may be formed into blocks and applied to a web of paper to reduce adherent properties of the paper. Further, a method of improving the handling properties of paper cut from a web is provided. The method includes the steps of coating a surface of a web of paper with an effective amount of a coating composition of the present disclosure, and cutting the web into sheets of paper.

8 Claims, 1 Drawing Sheet

FORMULATIONS FOR HIGH SPEED PRINT PROCESSING

CROSS REFERENCE TO RELATED APPLICATIONS

This application claims the benefit of U.S. Provisional Application Ser. No. 60/765,353, filed Feb. 3, 2006 incorporated herein by reference in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to printing systems and more particularly to a system that enables high-speed printing on a roll of paper.

2. Description of the Background of the Invention

Application of coatings and/or films to paper to impart beneficial attributes, such as improved gloss, greater electrographic recording resolution, increased printing density, and the like is known.

In some instances, heat-sensitive paper for thermally noting information in automatic recording apparatuses is prepared by applying onto a paper base a coating containing zinc stearate and ethyl cellulose. The recording is accelerated by forming the coating from 70-75 weight % zinc stearate and 25-30 weight % ethyl cellulose. The ethyl cellulose is dissolved in ethyl alcohol and zinc stearate is admixed. The resulting emulsion is applied onto the paper-base and dried. The weight of the coating is 3-4.5 g/m$^2$.

In other instances, a heat sensitive record material, such as paper, that does not pick-off onto hot type surfaces is coated with a colorless chromogenic material. Additional coating ingredients include a bisphenol distributed in a polyvinyl alcohol, a filler, a non-tacky wax, and a lubricant, such as zinc stearate. Other water insoluble stearates of calcium, iron, cobalt, nickel, aluminum, manganese, lead, and the like may be incorporated, as well.

In yet further instances, water-vaporproof paper for use as wrappers and the like is prepared by applying a coating composition that is a plasticized resin-ethyl cellulose wax compound. The coating mixture includes coumarone indene resin, ethyl cellulose, rosin and polyisobutene plasticizers, paraffin wax, and zinc stearate.

In further instances, in a method for making coated paper a coating composition is applied to a paper web forming a filter cake thereon. Excess composition forming the filter cake is removed by passing the paper web over a flexible wiper resulting in a smooth coating on the paper. The wiped paper is then passed over driers to dry the coating.

In yet further instances, an image forming apparatus employs a developer that includes a first lubricant preferably a metallic soap of zinc stearate. The image forming apparatus further includes a second lubricant that is applied to a surface of a photoreceptor by means of a cleaning brush. The second lubricant is preferably the same as the first.

The advent of in-line printing systems, which include, for example, printing, cutting, stacking, and inserting stations has placed new demands on paper attributes for obtaining and maintaining efficient operation. Paper conditioning stations in in-line printing systems help to ensure efficient operation of in-line printing systems.

SUMMARY OF THE INVENTION

According to one aspect of the present disclosure, an anti-blocking composition includes about 75% to about 99% weight percent a metal salt of stearate, about 1% to about 25% weight percent stearic acid, and optionally the balance an additive. The anti-blocking composition is formed into a block and applied to a web of paper to reduce adherent properties of the paper.

According to a further aspect of the present disclosure, an anti-blocking agent includes a homogeneous solid mixture of about 95% to about 97% by weight zinc stearate, about 3% to about 5% by weight stearic acid, and about 0% to about 1.5% by weight a cellulosic material. The cellulosic material includes fibers having a length of about 120 microns on average and a width of about 20 microns on average. The anti-blocking composition is formed into a block and applied to a web of paper to reduce adherent properties of the paper.

According to still another aspect of the present disclosure, a method of improving the handling properties of paper cut from a web includes the steps of coating a surface of a web of paper with an effective amount of a coating composition comprising about 75% to about 99% weight percent a metal salt of stearate and about 1% to about 25% weight percent stearic acid and cutting the web into sheets of paper.

DETAILED DESCRIPTION

Figure 1:
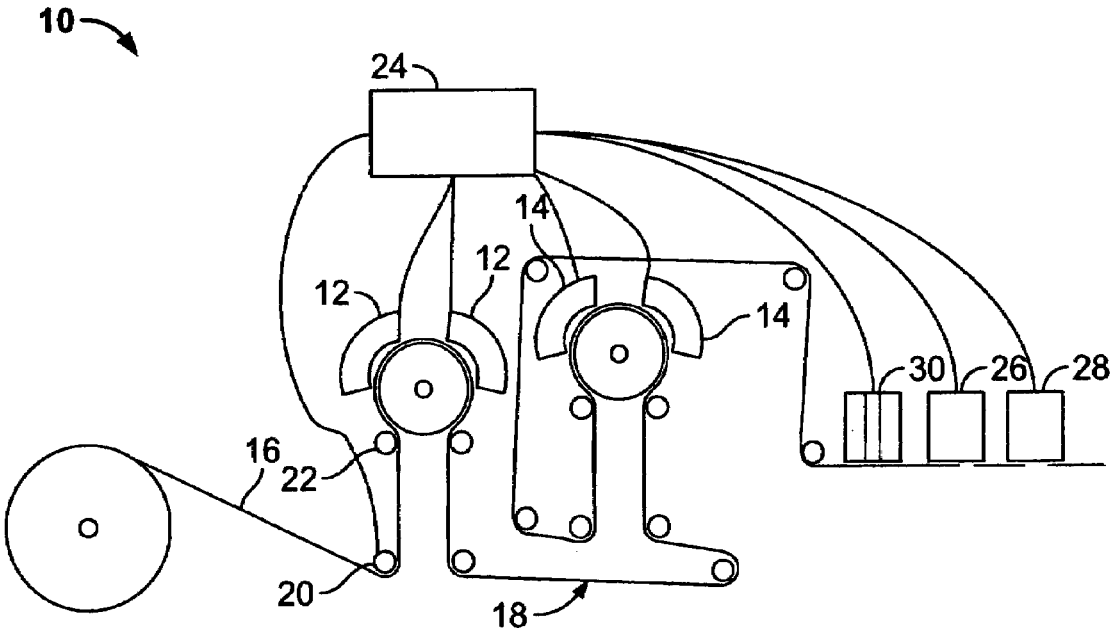
FIG. 1 is side view of a printing system.

The present disclosure is directed toward facilitating the handling of paper printed on an in-line system. FIG. 1 shows one example of an in-line printing system 10 configured with two main imaging units 12 and 14 wherein a first imaging unit 12 prints on a first side of the paper web 16 and a second imaging unit 14 prints on a second side of the paper web. The paper path 18 (from left to right in this example) through the imaging units 12 and 14 is arranged such that the paper web 16 need not be turned to permit duplex printing. If desired, only a single imaging unit may be provided to enable simplex printing on the paper web 16. Further configurations of the printing system 10 are contemplated to maximize functionality of the printing system and/or specialize the printing system for a particular application as is known to those skilled in the art of printing.

Control of the printing system 10 may be through methods known in the art. For example, servo-controlled cylinders 20 may be used to control the travel of the paper web 16 through the printing system 10. Further, paper tension may be monitored using one or more transducer rolls 22 before the first print unit 12 and by subsequent transducers (not shown) in each of the cylinders 20 associated with the imaging units 12 and 14 and/or downstream along the paper path 18. One or more programmable logic controllers 24 connected to the printing system 10 may be used to adjust the tension at the transducer rolls 22 and/or each of the cylinders 20 by adjusting the speed at which the rolls and cylinders rotate. The tension of the paper web 16 may be adjusted at each imaging unit 12 and 14 to compensate for changes in characteristics of the paper web as it is printed upon. The surface of the cylinders 20 may be textured so that friction between the paper web 16 and the cylinders insures that the rotation of the cylinders can drive the paper without slippage.

The printing system 10 contemplated herein may be used to produce stacked printed sheets of paper. Paper sheeting equipment 26 is generally used at the delivery end of the printing system 10 that cuts the paper web 16 into sheets of predetermined size. The sheeting equipment or cutter 26 may be programmatically controlled to ensure that correct page sizes are produced. In addition, one or more selective perforation systems (not shown) may be included at the delivery end of the printing system 10 to allow selected sheets to be perforated either in a direction parallel to the direction of the web path 18 and/or perpendicular thereto. Examples of such perforation systems are disclosed in U.S. Pat. Nos. 5,797,305 and 6,460,441, which are hereby incorporated by reference.

Sheets stacked by a stacker 28 may be further manipulated by another device called an inserter (not shown) by which the sheets may be combined with other printed sheets and inserted into envelopes and the like. For example, a high-speed inserter may be used to further arrange and/or distribute a stack of the printed sheets. Typically, sheets used with such an inserting machine have been printed using toner-based technologies known to those skilled in the art including electrophotography (for example, xerography) and ion deposition. A characteristic of toner printing is that a page printed with toner typically has a glossy finish that lowers the coefficient of friction between adjacent sheets in a stack. The coefficient of friction in toner printed sheets may also be lowered due to calendaring effects in systems using pressure transfer, lubrication during the toner fusing step, and/or the presence of lubricants within the toner itself. This reduced friction allows an inserting machine to pick up single sheets from a stack at a high rate without jamming. In contrast, inkjet printing typically does not produce a glossy finish or have the additional abovementioned lubricating effects associated with toner printing, and as a result, inserters are typically unable to pick up individual printed sheets from a stack of printed sheets at a desired rate without a greater risk for problems such as jamming.

To address potential issues with handling printed sheets that may arise when using non-toner based in-line printing systems, a lubricating step may be added to facilitate the processing of printed sheets. For example, a lubricating step contemplated herein may include the application of a coating composition to the paper web 16 and/or cut sheets by a coating station 30. The paper web 16 may be coated before and/or after the paper web is cut into individual sheets so that the sheets may be handled by inserters in a desirable fashion.

In one embodiment, a solid coating composition may include one or more metal salts of one or more fatty acids, such as stearic acid. Other fatty acids such as palmitic acid and/or myristic acid and the like may also be suitable for coating compositions contemplated herein. Examples of suitable metal salts of stearic acid include alkali metal, alkali earth metal, and/or transition metal salts of stearate and mixtures thereof. Examples of alkali metal salts of stearate include sodium stearate and lithium stearate. Examples of alkali earth metal salts of stearate include magnesium stearate and calcium stearate. Examples of transition metal salts of stearate include cadmium stearate and zinc stearate. While numerous examples of metal salts of stearate are contemplated for use in the present disclosure, those less toxic may be more preferred. Solid coating compositions contemplated herein may be formed into blocks that may be any size and shape. Further, the blocks contemplated herein may be formulated to be homogeneous, layered, and/or gradient in formulation.

In another embodiment, a solid coating composition may include a mixture of zinc stearate, stearic acid, and optionally an additive. An example of zinc stearate useful herein includes Zinc Stearate LG-3 (CAS# 557-05-1) available from Crompton/Chemtura. An example of stearic acid useful herein includes 60R Rubber Grade Stearic Acid (vegetable-based; CAS# 68440-15-3) available from Acme-Hardesty. Amounts of zinc stearate contemplated herein include from about 1% to about 99%, or about 50% to about 98%, or about 90% to about 97%, or greater than or equal to about 90%, or greater than or equal to about 95%, or greater than or equal to about 97%, or greater than or equal to about 99% by weight of the composition. Amounts of stearic acid contemplated herein include from about 0% to about 99%, or about 1% to about 50%, or about 1% to about 30%, or less than or equal to about 50%, or less than or equal to about 30%, or less than or equal to about 25%, or between about 1% and about 25% by weight of the composition. Amounts of additives contemplated include about 0% to about 99% by weight of the composition.

In a further embodiment, a solid coating agent may include a mixture of zinc stearate and a fiber. Examples of fibers useful herein include Createch TC 150 and TC90 available from CreaFill Fibers Corp. Additional fibers useful herein include polyethylene fibers, such as Spectra® available from Honeywell International Inc. Amounts of fiber contemplated herein include from about 0% to about 99%, or about 0.1% to about 50%, or about 0.5% to about 30%, or less than or equal to about 50%, or less than or equal to about 25%, or less than or equal to about 15%, or between about 0.5% and about 10% by weight of the composition.

Examples of suitable additives for coating compositions of the present disclosure include, for example, stearic acids, fiber, and silicones. Additional additives contemplated include, for example, a binder, an adhesive, a polymer, a resin, a heat sensitive agent, a synthetic material, a monomer, a solid, a liquid, a gas, a surfactant, an antistatic agent, a coloring agent, a bleaching agent, a desiccant, a wetting agent, a lubricant, a hydrophobic agent, a hydrophilic agent, a glossing agent, a matting agent, an alcohol, a soap, a detergent, a hardener, a wax, an oil, a filler, a pH adjusting agent, a sealant, a preservative, a UV blocker, a texturing agent, a fatty acid, a cellulose, a polysiloxane, Teflon®, a salt, a metal, a plasticizer, a tackifier, an anti-blocking agent, a solvent, and/or combinations thereof.

Additional additives contemplated herein include chemical indicators the detection of which can be used to indicate the degree of coating composition coverage of the coated paper. Examples of suitable chemical indicators include chemicals detectable in the infrared, ultraviolet, and/or fluorescent spectra, such as dyes, pigments, and other colorants. Further envisioned are fugitive chemical indicators that may be detected in the visible spectrum and/or invisible spectra or sensed via other methods known in the art. Examples of fugitive indicators include those that sublimate and/or evaporate, fade, change color, and the like known in the art.

Figure 2:
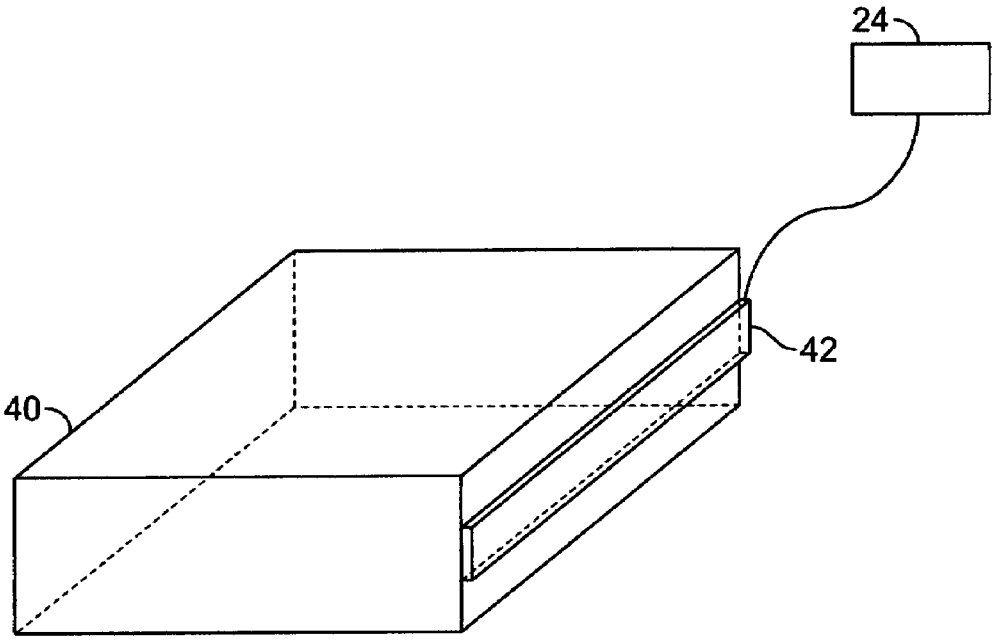
FIG. 2 is an isometric view of one embodiment of a coating composition.

Solid coating compositions may be molded into blocks using molds, as described below. Further, a block may be associated with one or more integral and/or external sensors designed to provide feedback from and/or about the block including, for example, when the block is near the end of its useful lifetime. As shown in FIG. 2, the block 40 is shown associated with a sensor 42. The solid coating composition mold may be pre-fitted with one or more sensors that will be subsequently contained within the block once the block solidifies and is subsequently removed from the mold. Alternatively or in addition, the sensor may be added after the non-solidified mixture has been added to the mold, or one or more sensors may be applied to the interior and/or exterior of the block once it has solidified. Further, the sensor 42 may also be a component of the coating station 30 and/or a coating composition applicator, as described below.

The sensor 42 may also monitor block temperature, internal pressure, block size, and/or other characteristics of the block that provide information pertaining to block lifetime, block integrity, coating composition application, and the like. Examples of useful pressure sensitive sensors and heat sensitive sensors include piezoelectric sensors, thermistors, thermocouples, resistance thermometers, and the like known to those skilled in the art. Information collected by the sensor 42 is sent to the programmable logic controller 24, which can then adjust appropriately parameters of the printing process to maintain ideal printing conditions. For example, the pressure of application of the solid coating composition block at the coating station 30 to the paper web 16 may be lessened by programmable logic controllers 24 if the pressure of application is considered too great and/or the heat of the coating composition block is too high. Similarly, the amount of solid coating composition applied to the paper web 16 may be adjusted to maximize the lifetime of the coating composition block while at the same time providing appropriate lubrication to the paper web.

Placement of a coating station 30 in the printing system 10 may be anywhere along the paper path 18 to maximize functionality of the printing system, such as, for example, to provide optimal paper friction during and/or after processing. For example, the coating station 30 may be placed downstream of the one or more imaging units 12 and 14 and prior to the paper web cutter 26. It is further contemplated that a paper web 16 may be precoated with a coating composition described herein and/or other treatments before being introduced into the printing system 10, in which case, the printing system may apply a separate additional coating or may forego such subsequent applications.

Mechanisms contemplated for use by the coating station 30 to apply the coating composition will typically correspond to the formulation of the coating composition. Based on the one or more formulations to be applied, the coating station 30 may incorporate an absorptive material, a sifter, a brush, a roller, a belt, a spatula or similar applicator, an extruder, a stamp, a mount, a bracket, a mold, and/or a brace to hold a solid coating composition block, and any combination thereof. Applicators may be primarily static, for example, a mounted bracket that may have limited movement, such as, for example, toward the paper web 16 and away therefrom. The applicators may also be dynamic, for example, they may have multiple dimensions of movement, such as, to allow simple and/or complex application patterns on the paper web 16. All other appropriate applicators known in the art are contemplated for use herein.

Application of a coating composition may be direct, for example, by contacting a block of solid coating composition to the paper web 16 as the paper web passes the coating station 30. Such an application process typically results in a thin deposition and/or lamination of the solid coating composition onto the paper web 16 from the solid block. Also contemplated are indirect applications of coating compositions, that may include an initial application of a coating composition onto a brush, a roller, and/or other appropriate applicator, which applicator is subsequently applied to the paper web 16. In addition, application of the coating composition may be on a single side of the paper web 16 or on both sides. Further, the application may coat an entire side of the paper web 16, or may be directed to a portion of such side. For example, the coating composition may be applied as one or more strips, dots, wavy patterns, random patterns, characters of various sizes, and the like. Application patterns imparted by the coating station 30 may be controlled by the programmable logic controller 24. In the case of duplex (two-sided) application of the coating composition, two coating stations 30 may be incorporated into the printing system 10. As well, the paper path 18 may be adjusted so that a single coating station 30 with plural application interfaces (not shown) may be employed to apply the coating composition to both sides of the paper web. Further, it is contemplated that a coating station 30 may apply any type of coating composition alone or in combination with one or more coating compositions of similar or different formulation as described above.

The amount of a coating composition applied to the paper web 16 may be controlled by adjusting the coating composition application rate. In one embodiment, the coating composition application rate may be controlled by adjusting the pressure with which the coating composition is applied to the paper web 16. In addition, the coating composition application rate may be adjusted through attenuating the application rate of the coating composition to the speed of the paper web 16. Further, coating composition application may also be controlled by varying the characteristics of the formulation being applied, such as the hardness of a solid coating composition. Without wishing to be bound by theory, it is contemplated that by, for example, increasing the hardness of a solid coating composition, the rate of application of the coating composition to the paper web 16 may be decreased compared to a softer solid coating compositions applied under the same conditions. Other methods known to those in the art for adjusting the amount of coating composition applied to the paper web 16 are also contemplated herein.

Coating composition application may be under ambient conditions, such as, for example, room temperature. Further, coating composition application may also be under warmer and/or cooler conditions than room temperature. Such variations in temperature may be implemented by heating and/or cooling the paper itself before and/or after application of the coating composition, and/or by heating or cooling the coating composition itself. To this end, the coating station 30 may be equipped with heating and/or cooling elements to adjust the coating composition to a desired temperature.

EXAMPLES

Example 1

The following example is illustrative of one embodiment of a coating composition contemplated herein. A solid coating composition block including zinc stearate and stearic acid was formulated. The block of zinc stearate and stearic acid was formulated by melting Zinc Stearate LG-3 powder and 60R Rubber Grade stearic acid together and thoroughly blending the melt blend to form a homogeneous mixture. The mixture was thereafter poured into a mold that had been heated to the same temperature as the mixture and both the mold and the mixture therein were allowed to cool to room temperature. The resulting block of coating composition contained 95% to 97% zinc stearate and 3% to 5% stearic acid.

Example 2

The following example is illustrative of a further embodiment of a solid coating composition block. Blocks of zinc stearate and cellulose are similarly formed as in Example 1, as follows. Zinc Stearate LG-3 powder is melted. Createch TC 150 cellulose fibers are mixed into the melted zinc stearate. The mixture is thereafter poured into a mold that is electrically heated to the same temperature as the mixture and both the mold and the mixture therein are allowed to cool to room temperature. The resulting block of coating composition contains 98.5% zinc stearate and 1.25% cellulose fiber.

INDUSTRIAL APPLICABILITY

The present invention in one embodiment provides a coating composition useful for reducing blocking of paper. For example, the coating composition may be applied to a web of paper in an in-line printing process. Upon cutting and stacking of the coated paper, individual sheets of paper may be handled more easily by an inserter, thus promoting the production of a printed product.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. All patents and other references cited herein are incorporated herein by reference in their entirety.

The invention claimed is:

1. A solid anti-blocking composition, comprising:

about 75% to about 99% weight percent a metal salt of stearate;

about 1% to about 25% weight percent stearic acid; and optionally the balance an additive.

2. The anti-blocking composition of claim 1, wherein the metal salt is zinc.

3. The anti-blocking composition of claim 2, wherein the anti-blocking composition, on a weight percent basis, comprises:

about 90% to about 98% zinc stearate; and about 2% to about 10% stearic acid.

4. The anti-blocking composition of claim 3, wherein the composition comprises:

about 95% to about 97% zinc stearate; and about 3% to about 5% stearic acid.

5. The anti-blocking composition of claim 1, wherein the composition is formulated as a homogeneous solid.

6. The anti-blocking composition of claim 1 wherein the composition is formed into a solid block.

7. The anti-blocking composition of claim 6 wherein the solid block has a sensor contained therein.

8. The anti-blocking composition of claim 1 further comprising an effective amount of a chemical selected from the group consisting of a chemical indicator and a fugitive indicator that provides an indication that the web has been coated.

* * * * *